US006012749A

United States Patent [19]

Farber et al.

[11] Patent Number: 6,012,749

[45] Date of Patent: Jan. 11, 2000

[54] CORN HOLDER

[75] Inventors: John David Farber; Hugh William Biber, both of New York, N.Y.

[73] Assignee: General Housewares Corp., Terre Haute, Ind.

[21] Appl. No.: 09/103,129

[22] Filed: Jun. 23, 1998

[51] Int. Cl.[7] ..... A47G 21/00

[52] U.S. Cl. ..... 294/5; D7/684

[58] Field of Search ..... 294/1.1, 5, 5.5, 294/61; 30/124; 99/419, 421 A; D7/683–685; D21/576, 610, 611, 654

[56] References Cited

U.S. PATENT DOCUMENTS

| | | | |
|---|---|---|---|
| D. 26,777 | 3/1897 | Donnelly | 294/5 |
| D. 105,824 | 8/1937 | Romano | D21/654 |
| D. 132,946 | 7/1942 | Weil . | |
| D. 157,001 | 1/1950 | Reinecke . | |
| D. 178,495 | 5/1956 | Cohen . | |
| D. 183,448 | 9/1958 | Dawson . | |
| 201,230 | 3/1878 | Yongh | 294/5 |
| D. 207,412 | 4/1967 | LaBarbera . | |
| D. 306,114 | 2/1990 | Moll . | |
| D. 331,525 | 12/1992 | Anderson | D7/683 |
| D. 359,203 | 6/1995 | Wedderburn . | |
| 567,284 | 9/1896 | Stebbins . | |
| 933,402 | 3/1909 | Townsend . | |
| 2,823,490 | 2/1958 | Griem | D21/611 |
| 2,964,872 | 12/1960 | Coleman | D21/611 |
| 3,995,902 | 12/1976 | Sciaino, Jr. . | |
| 4,163,575 | 8/1979 | Riedinger, Jr. et al. . | |
| 5,088,782 | 2/1992 | Scott . | |
| 5,566,997 | 10/1996 | Lin . | |

*Primary Examiner*—Dean J. Kramer
*Attorney, Agent, or Firm*—Emrich & Dithmar

[57] ABSTRACT

The corn holder comprises one element which is a portion of a generally elongated animal such as a dog. That portion includes at least the dogs head. The body also comprises another element which is the rest of the animal. Each element has a generally planar surface transverse to the direction of elongation. Two tines extend from each surface to insert into the end of an ear of corn.

3 Claims, 1 Drawing Sheet

CORN HOLDER

BACKGROUND OF THE INVENTION

Current corn holders include two identical pieces each with a pair of tines that are inserted into the end of an ear of corn.

SUMMARY OF THE INVENTION

It is an important object of the present invention to provide an improved corn holder.

Another object is to provide a corn holder which is more interesting.

In summary, there is provided a corn holder comprising a first element being a portion of a body, a second element being the rest of the body and at least one tine extending from each portion.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the advantages should be readily understood and appreciated.

DETAILED DESCRIPTION OF THE PREFERRED EMBODIMENT

Figure 1:
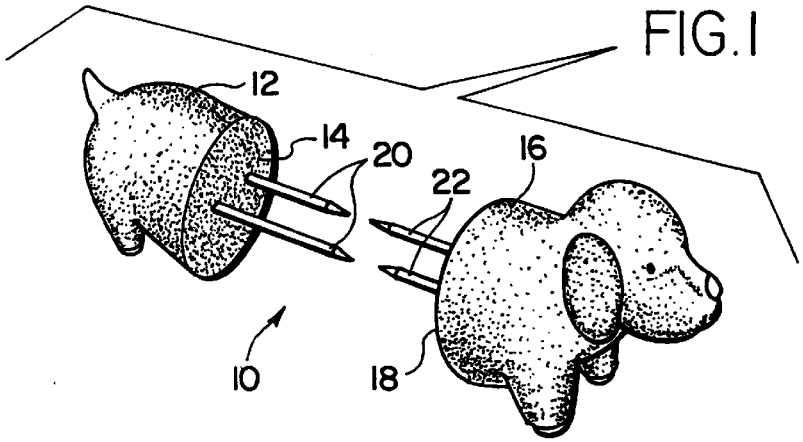
FIG. 1 is a perspective view of the two elements of a corn holder made in accordance with and embodying the features of the present invention.
Figure 2:
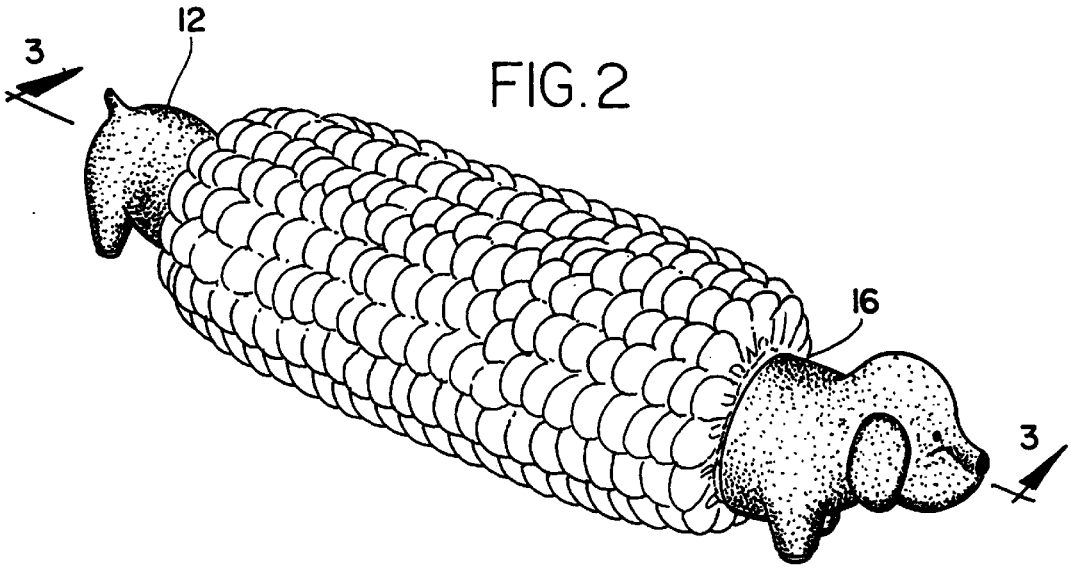
FIG. 2 is a perspective view of an ear of corn to which the corn holder has been applied.
Figure 3:
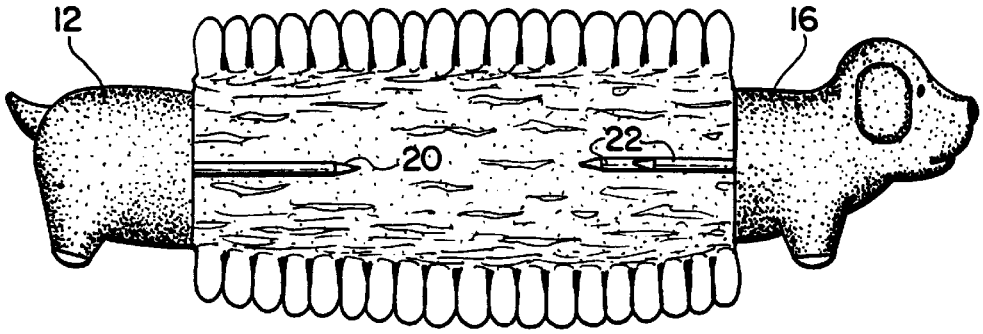
FIG. 3 is a view in section of the ear of corn, the corn holder being shown in elevation.

Turning now to the drawings, there is depicted a corn holder 10 comprising a first element 12 being a portion of a body and a second element 16 being the rest of the body. In this case, the body is an animal, particularly, a dog. Thus, element 12 is the rear of the dog having a tail and two legs, and element 16 is the front portion of the animal, or in this case the dog, with two legs, a head and ears.

Element 12 has a generally planar surface 14 generally transverse to the direction of elongation of the animal and the second element 16 also has a generally planar surface 18 transverse to the direction of elongation. A pair of substantially parallel tines 20 extend from surface 14 and a pair of tines 22 extend from surface 18 of element 16.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

What is claimed is:

1. A corn holder comprising a first element being a portion of a generally elongated animal including at least the head and a portion of the body of the animal, a second element being the remaining portion of the body of the animal, said body portions respectively having a generally planar surfaces transverse to the direction of elongation and of substantially the same size and at least one tine extending from each surface.

2. The corn holder of claim 1, wherein the animal has four legs, two of which are in the first element and two of which are on the second element.

3. The corn holder of claim 1 and further comprising an additional tine on each of said surfaces substantially parallel to the tine thereon.

* * * * *